US005566992A

United States Patent [19]

Anderson et al.

[11] Patent Number: 5,566,992

[45] Date of Patent: Oct. 22, 1996

[54] MECHANISM FOR LATCHING AND UNLATCHING A HATCH ASSEMBLY

[75] Inventors: Andrew Anderson, Chester, Vt.; Gregory S. Fallon, Charlottesville, Va.

[73] Assignee: Pompanette, Inc., Charlestown, N.H.

[21] Appl. No.: 317,545

[22] Filed: Oct. 4, 1994

[51] Int. Cl.[6] ..... E05C 3/04

[52] U.S. Cl. ..... 292/241; 292/256.5

[58] Field of Search ..... 292/240–242, 292/256.5, DIG. 5, DIG. 30

[56] References Cited

U.S. PATENT DOCUMENTS

| | | | |
|---|---|---|---|
| 205,568 | 7/1878 | Morris | 292/240 |
| 543,765 | 7/1895 | Elting . | |
| 815,537 | 3/1906 | Kissinger | 292/241 |
| 1,898,543 | 2/1933 | Johnson | 292/241 |
| 1,919,328 | 7/1933 | Hansen . | |
| 1,957,642 | 5/1934 | Hansen | 292/241 |
| 2,361,298 | 10/1944 | Laddon . | |
| 2,914,000 | 11/1959 | Mulcahy . | |
| 3,652,112 | 3/1972 | Panelli | 292/241 |
| 3,913,971 | 10/1975 | Green . | |
| 4,683,731 | 8/1987 | Wickman | 292/241 |

*Primary Examiner*—Steven N. Meyers
*Assistant Examiner*—Gary Estremsky
*Attorney, Agent, or Firm*—David E. Dougherty

[57] ABSTRACT

A hatch dog handle mechanism includes a rotatable hub assembly which includes a handle, a locking lug. A locking plate or portion of the frame is also provided for engagement by the locking lug. The locking lug is rotatable about a central axis through a limited arc by the handle. The handle is also rotatable through a limited are about a second axis which is perpendicular to the first axis. The mechanism also includes a locking element to prevent rotation of the handle about the second axis and a second locking element to prevent rotation of the handle about the first axis when in a first position with respect to the second axis.

3 Claims, 4 Drawing Sheets

MECHANISM FOR LATCHING AND UNLATCHING A HATCH ASSEMBLY

FIELD OF THE INVENTION

This invention relates to a mechanism for latching and unlatching a hatch assembly and more particularly to a hatch dog handle mechanism for releasing and securing the hatch cover from and in a closed position.

BACKGROUND FOR THE INVENTION

Cast aluminum boat hatches are well known. For example, such hatches are commercially available from Pompanette, Inc. of Charlestown. N.H., the assignee of the present invention, and typically include a cast aluminum alloy frame, and elastomer gasket and a clear plastic cover. The hatch cover is typically made of LEXAN® sheet, a product of General Electric that has the strength of more than 5 inches of acrylic. Such hatches are frequently equipped with quick action tie down dogs.

Conventional hatch dog handle mechanisms include a locking button which must be depressed in order to rotate the handle to open the hatch. Such locking buttons are susceptible to sticking and at times, due to corrosion, make it difficult to release the handle and open the hatch.

It is presently believed that there is a commercial demand for an improved hatch dog handle mechanism which would eliminate the need for a locking button. The hatch dog handle mechanism should also minimize the likelihood of scratching the lens, i.e., clear plastic window during latching and unlatching and at the same time minimize the likelihood of snagging lines by providing a close fit between the handle and lens when in a locked position. It is also believed that improved hatch dog handle mechanisms in accordance with the present invention have all of the aforementioned features.

BRIEF SUMMARY OF THE INVENTION

In essence, the present invention contemplates an improved mechanism for latching and unlatching a hatch wherein the mechanism can be locked and unlocked with out a need for a locking button. The mechanism includes a locking plate or a portion of the hatch frame which may act as a locking plate and a hub assembly having a central axis and means for attaching the hub assembly to the hatch. The hub assembly also includes an outwardly extending lug and an outwardly extending handle which is adapted to rotate about the axis and at the same time rotate the lug about the same axis. In a preferred embodiment of the invention, the lug and handle are offset by about 90°. Rotation of the handle about the central axis in a first direction brings the locking lug and locking plate into locking engagement while rotation in the opposite direction unlocks the hatch for opening thereof. The assembly also includes means for rotating the handle about a second axis which is essentially perpendicular to the central axis in a manner which is independent of the locking lug. A locking element such as a snap fit fastener prevents rotation of the handle about the second axis and biases the handle into a position which is relatively close to the hatch, i.e., hatch cover. Locking the handle in this position also prevents the handle from being rotated about the central axis. For example, when the handle is in a locked position, it will be necessary to overcome the bias of the locking element by pulling down on (or inwardly) on the handle which frees it from the locking element. Once free, the handle can be rotated about its central axis to unlock the hatch.

The invention will now be described in connection with the accompanying drawings wherein like reference numerals have been used to designate like parts.

DETAILED DESCRIPTION OF A PREFERRED EMBODIMENT OF THE INVENTION

Figures 1, 1A:
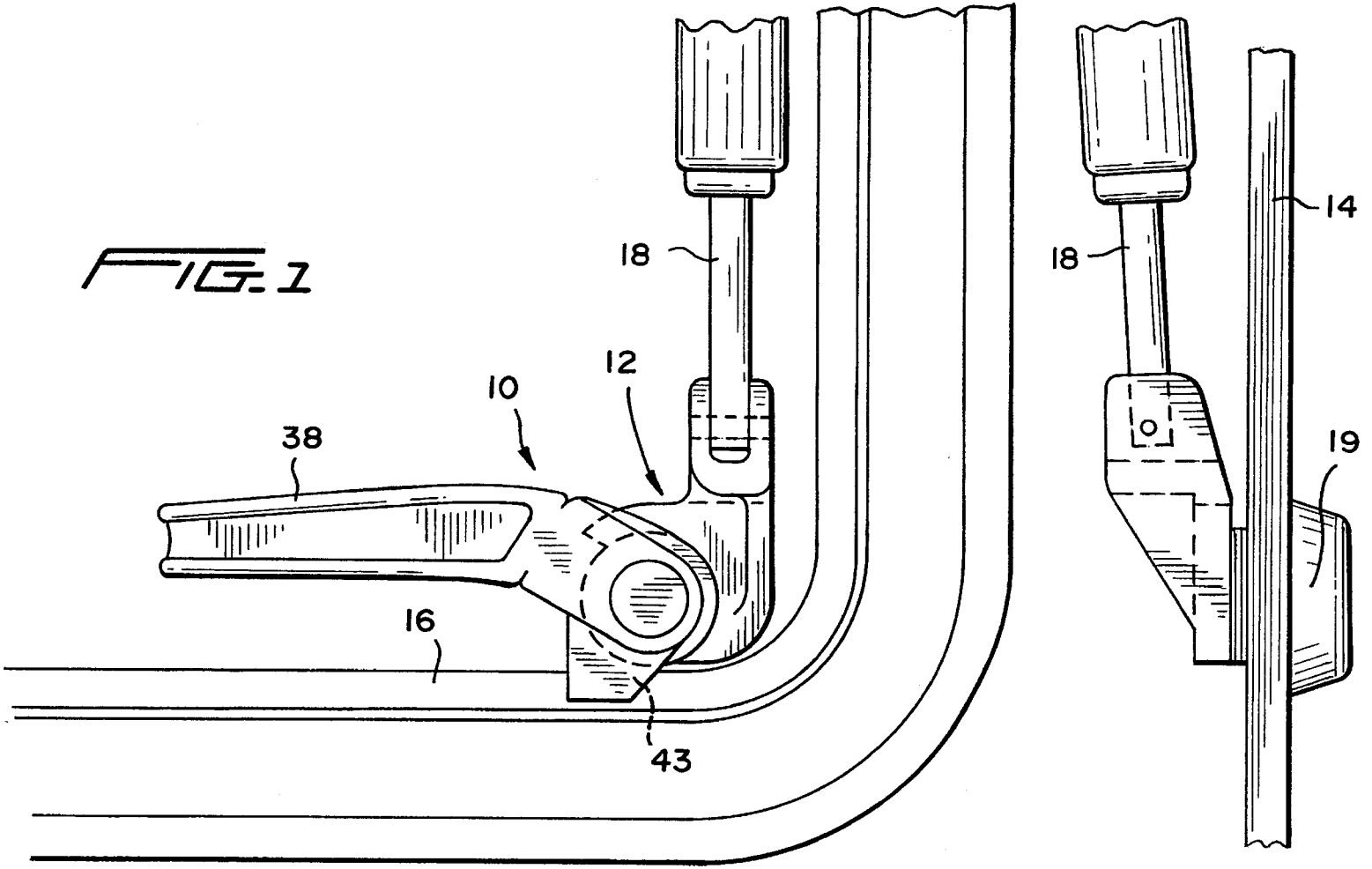
FIG. 1 is a top or plan view of a portion of a hatch assembly including a hatch dog handle mechanism in accordance with a preferred embodiment of the invention.
FIG. 1*a* is a side elevational view illustrating a portion of the hatch shown in FIG. 1 but with the handle position of the mechanism removed.
Figure 2:
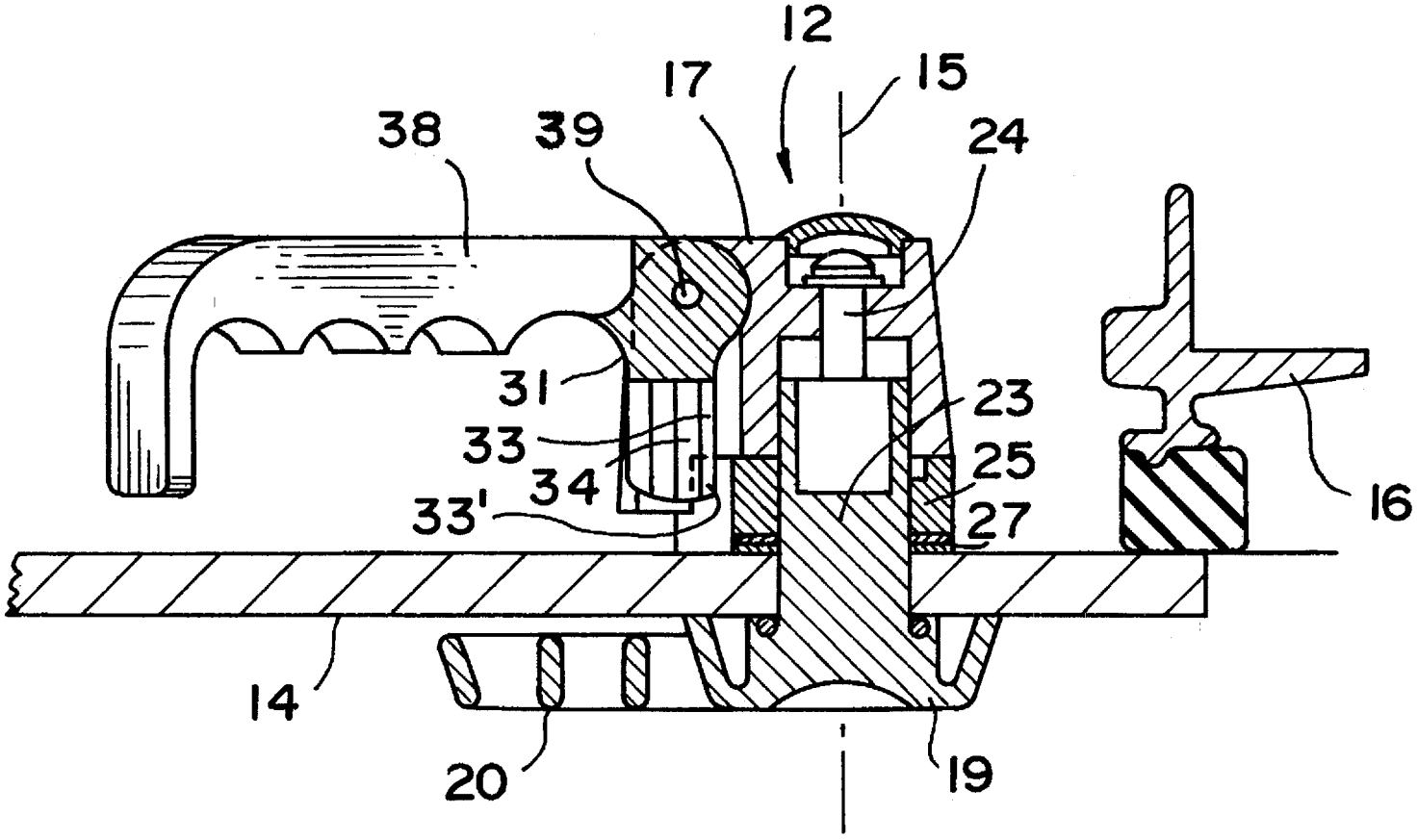
FIG. 2 is a cross sectional view illustrating the hatch assembly according to the preferred embodiment of the invention.
Figure 2A:
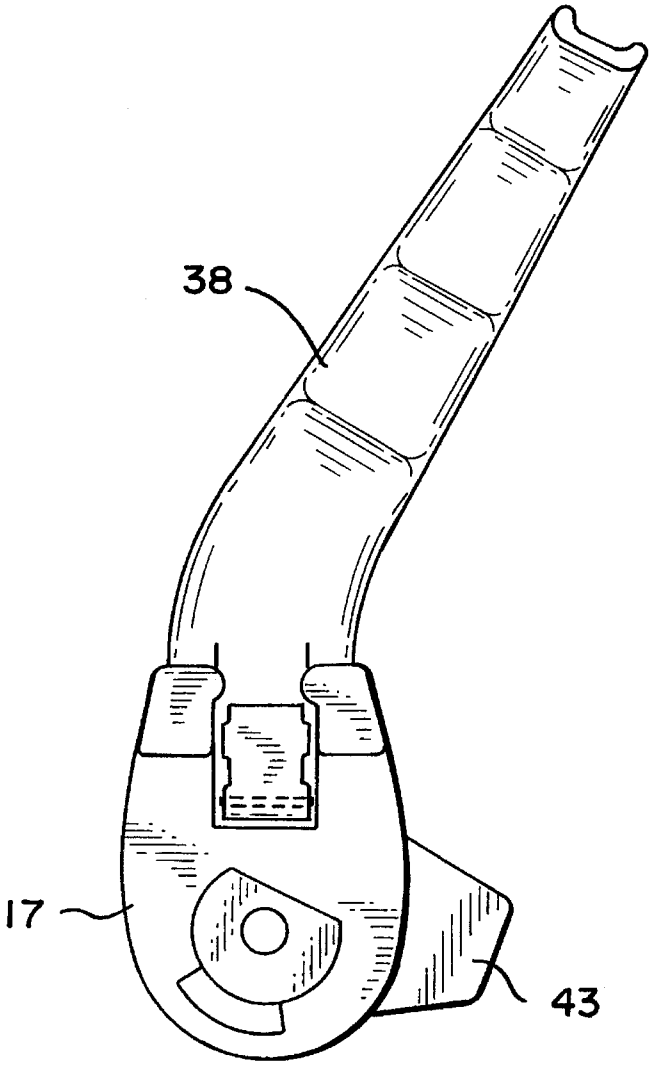
FIG. 2A is a bottom view of the rotatable hub and handle shown in FIG. 2.
Figure 6:
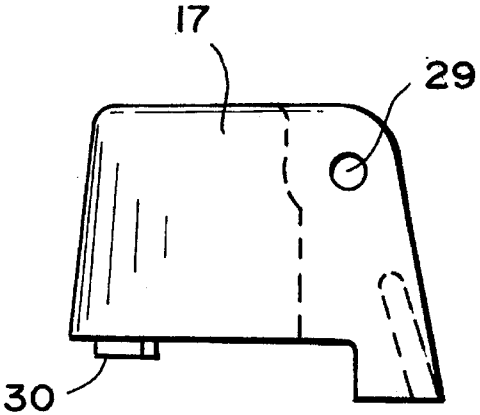
FIG. 6 is a side elevational view of the outer hub shown in FIG. 5.
Figure 5:
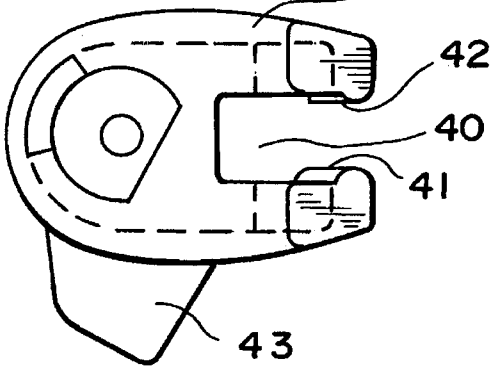
FIG. 5 is a top or plan view of an outer hub assembly with an eccentric portion which is incorporated into the preferred embodiment of the invention.

As illustrated in FIGS. 1 and 2, a hatch dog handle mechanism 10 includes a hub assembly 12 which is mounted on a first portion of a hatch 14 in a conventional manner. The hatch 14 or hatch cover engages a frame 16 which is made of cast aluminum or other suitable material. In a preferred embodiment of the invention, the frame is made of ALAMG 35 which has a relatively high resistance to corrosion. The hatch 14 or hatch cover is made from LEXAN sheet which may be tinted a dark smoke color that lets in about 80% of the available light.

The hub assembly 12 is preferably mounted on the hatch 14, i.e., the hatch cover but could be mounted on the frame 14. Fur this reason, the term "hatch" is sometimes used to refer to the frame and/or cover. The hub assembly 12 also includes a central axis 15 and rotates about that axis in a manner which will be described hereinafter. For example, the assembly 12 includes a first rotatable member 17 disposed on the bottom or inside of the hatch 14, and an element 19 which is disposed on the opposite side thereof. A gasket or seal 27 consists of an elastomer which provides resistance to salt water and pressure. Such elastomers are well known by those who are skilled in the art of manufacturing hatches.

The element 19 includes a downwardly extending projection 23 which extends through a hole in the hatch cover, downwardly from the hatch cover and is fixed to the rotatable member 17 by means of a screw 24. The element 19 may also include an integral handle 20 as shown in FIG. 2 which allows the hatch to be latched or unlatched from the outside when in an unlocked position. A collet arm 18 shown in FIGS. 1 and 1*a* may be used to clamp the hatch in an open position.

Figure 3:
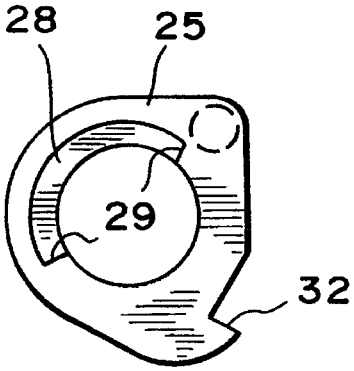
FIG. 3 is top or plan view of a stationary hub or support member which is incorporated into the hatch assembly shown in FIG. 2.
Figure 4:
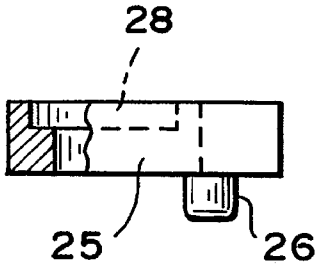
FIG. 4 is a side elevational view of the support member shown in FIG. 3 with a portion broken away and shown in cross section.

The hub assembly 12 also includes an inner stationary hub member 25 which is shown more clearly in FIGS. 3 and 4. The stationary hub member 25 also includes a downwardly projecting pin 26 which extends downwardly from the base of the hub member 25 and which fits into a corresponding hole in the lens portion of the hatch cover 14. This pin 26 prevents the hub member 25 from rotating. The hub member 25 also has a cylindrical passageway which provides a snug fit for an inwardly projecting projection 23 which is free to rotate therein. The assembly 12 also includes a gasket 27 which forms a seal between the cover 14 and the member 25.

In the preferred embodiment of the invention, means are provided for limiting the rotation of the hub assembly 12 through an arc of about 75°. For example, a recess 28 in the stationary hub member 25 includes a pair of shoulders 29. A stop member 30 fits on rotatable member 17 within recess 28 and is free to rotate therein until it engages one of the stops or shoulders 29. The hub member 25 also includes an outer stop or shoulder 32 on the outer periphery thereof which prevents rotation of the hub assembly 12 when it is in a locked position.

In the preferred embodiment of the invention, a rotatable handle 38 is constructed and arranged to rotate the hub assembly 12 when in a first position and to prevent rotation of the hub assembly 12 when in a second or locked position. For example, the handle 38 includes an integral downwardly projecting locking member 31 which includes a pair of parallel and longitudinally extending raised portions 32 and 33 separated by a parallel longitudinally extending recessed portion 34. This handle 38 is pivotably mounted to the first rotatable member 17 by means of a hinge pin 39. The hinge pin 39 extends through rotatable member 17 and is essentially perpendicular to the axis 15 so that the handle 38 rotates upwardly and downwardly between a locked and unlocked position. The rotatable member 17 also defines a downwardly extending channel 40 for receiving the downwardly projecting locking member 31 and also includes two inwardly directed projections 41 and 42. The rotatable member 17 also includes a latching lug 43 or outwardly extending ear which is adapted to engage a portion of the frame 16 or other locking plate to lock the hatch in a closed position. Means are also preferably provided for limiting the rotation of the handle about the second axis to about 30° so that the handle does not project into the cabin. For example, a pin 33' on the locking member 31 may be provided for engaging projections 41 and 42 to prevent excess rotation.

In the operation of a mechanism 10, the handle 38 is pushed downwardly (as illustrated in FIG. 2) into a locked position so that the locking member 31 engages the stop or shoulder 32. However, as shown in FIG. 1 which is analogous, to a hatch in the top of a cabin, the handle 38 would be pushed inwardly toward the hatch into the locked position. Pulling down on the handle 38 (FIG. 1) rotates the handle 38 about the pivot 29 which forces projections 41 and 42 apart so that the locking member 31 is moved outwardly beyond shoulder 32. At this point, the handle 38 is used to rotate member 17 and lug 43 so that the hatch may be opened. Upon closing the hatch, the handle 38 is rotated to bring the lug 43 into locking engagement with the frame 16 as shown in FIG. 1. Once locked, the handle 38 is pushed toward the hatch 14 so that the longitudinal projections 33 and 34 force the projections 41 and 42 apart until the resiliency of the rotatable element snaps the handle into its locking position with projections 41 and 42 within the recedes 34.

While the invention has been described in connection with its preferred embodiment, it should be recognized that changes and modifications can be made therein without the departing from the scope of the appended claims.

What is claimed is:

1. A mechanism for latching and unlatching a hatch comprising a locking plate adjacent to the hatch and a hub assembly having a central axis and means for attaching said hub assembly to the hatch, said hub assembly including a rotatable hub and a stationary hub having a first stop member on the outer periphery thereof, said rotatable hub including an outwardly extending handle and a eccentric element including an outwardly extending locking lug extending from said hub and rotatable about said central axis in response to the rotation of said handle to thereby bring said locking lug into engagement with said locking plate when said handle is rotated about said central axis in a first direction and to move said locking lug out of engagement with said locking plate when rotated in the opposite direction, means including a recess and a pair of shoulders in said stationary hub and a second stop member on said rotatable hub extending into said recess for limiting the rotation of said handle about said central axis to about 75°, means for rotating said handle independently of said locking lug about a second axis which is essentially perpendicular to said central axis and motion limiting means extending from said handle for engaging said first stop member on the outer periphery of said stationary hub to prevent rotation of said handle about said central axis when said handle is in a first position with respect to said second axis and permitting rotation of said handle about said central axis when said handle is in a second position with respect to said second axis and means for limiting the rotation of said handle about said second axis to about 30° and wherein said handle includes a projecting locking member and said rotatable hub includes a U-shaped channel and a pair of inwardly directed projections which are constructed and arranged to receive said locking member therebetween and wherein said locking member is constructed and arranged to force said inwardly directed projections apart so that the resiliency of the U-shaped channel biases the handle into an open or closed position.

2. A mechanism for latching and unlatching a hatch according to claim 1 in which said handle includes a first projecting portion having a pair of parallel longitudinally extending raised rib members and a parallel longitudinally extending recess separating said ribs.

3. A mechanism for latching and unlatching a hatch according to claim 2 in which said stationary hub defines a channel and a pair of inwardly directed projections extending into the channel and in which the channel is adapted to receive said first projecting portion therein.

* * * * *